US006335749B1

(12) United States Patent
Carizzoni et al.

(10) Patent No.: US 6,335,749 B1
(45) Date of Patent: Jan. 1, 2002

(54) PROCESS AND APPARATUS FOR PRINTING AND DECORATING BY MEANS OF SUBLIMABLE INKS

(75) Inventors: Ilario Carizzoni, Cologno Monzese Mi; Giovanni Ferrari, Concesio Bs; Francesco Spolaor, Milan, all of (IT)

(73) Assignee: V.I.V. International S.p.A., Cazzano di Tramigna (IT)

( * ) Notice: Subject to any disclaimer, the term of this patent is extended or adjusted under 35 U.S.C. 154(b) by 0 days.

(21) Appl. No.: 09/110,489

(22) Filed: Jul. 6, 1998

(30) Foreign Application Priority Data

Jul. 4, 1997 (IT) ..... MI97A1582

(51) Int. Cl.[7] ..... B41J 2/315; B44C 1/165
(52) U.S. Cl. ..... 347/171; 347/193; 156/240
(58) Field of Search ..... 437/171, 187, 437/185, 194, 213, 113; 428/34.9, 35.1, 35.2, 319.7; 156/229, 235, 240, 228

(56) References Cited

U.S. PATENT DOCUMENTS 5,368,953 A 11/1994 Zaborney et al. ..... 429/90
5,718,792 A * 2/1998 Goode ..... 156/228

FOREIGN PATENT DOCUMENTS

| | | |
|---|---|---|
| EP | 0128717 | 12/1984 |
| FR | 2691108 | 11/1993 |
| FR | 2719805 | 11/1995 |
| WO | WO8501018 | 3/1985 |

OTHER PUBLICATIONS

Patent Abstracts of Japan, vol. 007, n.112, May 17, 1983.
Patent Abstracts of Japan, vol. 007 n.112 (M–215), May 17, 1983.

* cited by examiner

*Primary Examiner*—Hai C. Pham
(74) *Attorney, Agent, or Firm*—Collard & Roe, P.C.

(57) ABSTRACT

A process for printing and decorating an article by the use of sublimable inks, includes providing preformed images on a substrate, these preformed images are obtained using the sublimable inks; applying the substrate on surfaces of the article; applying a pressure to the preformed images for pressing the preformed images against the surfaces, providing a heat thermoretractable material and heating the heat thermoretractable material at a temperature suitable for causing a thermoretraction of the heat thermoretractable material for generating the pressure; heating the preformed images until the sublimable inks are transferred by sublimation onto the surfaces. The thermoretractable material can be polyethylene terephthalate (PET) or polyethylene naphthalate (PEN). An apparatus for printing and decorating an article by the use of sublimable inks has compression parts for applying a pressure to images provided on a substrate applied on surfaces of the articles. The images are obtained using the sublimable inks, a heater for heating the images at a temperature suitable for obtaining a transfer of these images on the surfaces by sublimation of the sublimable inks. The compression parts include a heat thermoretractable material, and the thermoretractable material which is PET or PEN.

17 Claims, 2 Drawing Sheets

PROCESS AND APPARATUS FOR PRINTING AND DECORATING BY MEANS OF SUBLIMABLE INKS

BACKGROUND OF THE INVENTION

1. Field of the Invention

The invention relates to a process and an apparatus for printing and decorating various articles by means of inks of the type applicable by sublimation.

2. The Prior Art

As is known, many articles, even of common use, are at present printed or decorated by processes utilising special inks that can be transferred and applied by sublimation.

Sublimation is a direct transformation from the solid to the vapour state and the special sublimable inks, prepared on supports or sheets from fabric, paper or the like, transfer by sublimation from the sheets to the articles to be printed or decorated when said supports or sheets are kept closely adhering to the articles and heated.

Sublimation printing or decoration has many advantages compared to other decoration means.

In fact, ink vapours penetrate the printed material and generate vivid and very agreeable, resistant, no-thickness decorations, i.e. such as to support even a heavy wear or abrasion, with a high resistance also to the aggression of many acids and bases.

The best results are achieved with some plastic materials for the penetration in the same of sublimable inks, but all materials may be sublimation-printed if a an adherent paint layer is previously applied on the same.

Sublimation printing of substantially flat articles is easily realisable and is generally carried out with hot presses, which press sublimable-ink-bearing sheets on the articles to be decorated.

The temperature to be reached is comprised between about 180 and 215° C., depending on the inks and colours utilised, and the pressure must suffice to ensure a direct touch between the plates and the articles. Sublimation printing of articles of various shape and size is much more complex.

In this case, special apparatuses are generally employed that are provided with silicone elastic membranes, very soft and thin, between which the articles to be printed are inserted.

The supports or sheets carrying the sublimable ink are interposed between the articles and the membranes. Suction pumps create vacuum between the membranes, so that they adhere to the articles, stretching and pressing the inked sheets. Then heat is applied to reach said ink-sublimation temperatures.

This known technique has many drawbacks. There has bee realised a process for the production of large-size, variously decorated sections, which was the subject matter of the International Patent application PCT/EP96/00656, filed on Feb. 2, 1996; the process comprises the steps of winding of the artefact, previously subject to a surface treatment of pre-painting, anodic oxidation and the like, in a transfer support carrying the wished decoration; covering the section wrapped in the support with a membrane from rubber or the like; vacuum formation by means of suitable ducts between the membrane and the section wrapped in the support, an prior interposition of means suitable to ensure air flow and outlet, so as to cause the support to closely adhere to the shape of the artefact, and complying means suitable to obtain the uniformity of the pressure exercised by the membrane; and lastly heating the whole so as to obtain the transfer of the pattern and the polymerisation of colours.

A first drawback is due to the very fact that the approaching of two membranes to the articles determines connection zones between the membranes in whose correspondence adhesion is lower. There exist therefore zone wherein printing does not take place or takes place with a quality lower with respect to other zones. Besides, if the surfaces to be decorated are very irregular, the membranes poorly adhere in any case to these surfaces.

It is not possible to obviate this drawback by increasing the pressure exercised on the membranes, which remains limited to the atmospheric pressure, to cause the same to adhere to all points of said surfaces.

Neither is it possible to vary pressure according to sites, for instance to nuance the impressed decoration. The number of articles that can be printed each time is also reduced and depend on the size and the weight of said articles. The weight is important as it is supported by the membranes.

On each working cycle, the membranes are submitted to a marked stretching: said membranes deform many time each day to adjust to the wrapped articles, and in these conditions they undergo a high temperature heating.

Therefore, they loose their elasticity in a short time and adhere with an increasingly lower precision to the most irregular shapes. This drawback is important as the membranes in question are very expensive and cannot be immediately replaced if only a partial loss of elasticity has taken place.

Moreover, the articles to be decorated must be free from holes or sharp edges, to prevent membranes from slitting or breaking.

Therefore, it is indispensable to carry out a starting work of preparation of the articles to be printed, with a provisional closing of holes.

The preparation work must be carried out also for the interposition of the supports or sheets bearing the sublimable ink: actually, the same require great preparation ability, as the blind membranes cover the support, preventing a clear perception of their positioning.

Neither is it possible to keep for a long time the articles between the membranes, once ink sublimation has taken place, as the apparatuses must be used uninterruptedly, to reduce the incidence of the cost of the same on decoration operations.

As a consequence of the above, when the printed articles are collected, the still hot ink solvents give off in the environment, affecting the operators adversely and polluting the atmosphere.

Lastly, it must be stressed that the colours that have undergone the sublimation chemical process deposit partly on the membranes and that these colours may partly pollute the subsequent printing operations.

Thus, it is also necessary to provide for a continuous cleaning of the membranes, with an increase in global costs.

SUMMARY OF THE INVENTION

In this situation, it is an object of the present invention to provide a process and a sublimation printing apparatus able to substantially obviate the aforesaid drawbacks. Object of this invention is also to provide a process allowing to obtain large size sections having a length of up to 20 m, variously decorated, to be used for the production of doors and windows, also for outdoor use, having the requirements of quality, weatherproofing and resistance to ageing, provided for by the different international norms and by quality marks.

A further object of this invention is to provide a process for the realisation of sections, in particular from metal, aluminium and aluminium alloys, plastic materials, composite materials (such as resins reinforced with carbon and or glass fibres and the like) provided with decorations in one or more colours, such as geometric, floral, imitation wood, imitation marble decorations, and also decorations comprising very complex patterns, exempt from defects such as deformations of pattern edges, smears, diffusion and superposition of colours and the like, and using a process with a low manpower need.

Still a further object of the invention is to provide an apparatus suitable for realising said process for the decoration of said sections.

The specified technical task is substantially achieved by a process and an apparatus for printing and decorating by means of sublimable inks characterised in that they comprise any of the new technical solutions described hereunder and claimed, or any combination of the same.

BRIEF DESCRIPTION OF THE DRAWINGS

There is now reported hereunder, by way of non limiting example, the description of preferred embodiments of a process and an apparatus according to the invention, illustrated in the attached drawings, wherein.

DETAILED DESCRIPTION OF PREFERRED EMBODIMENTS

Figure 1:
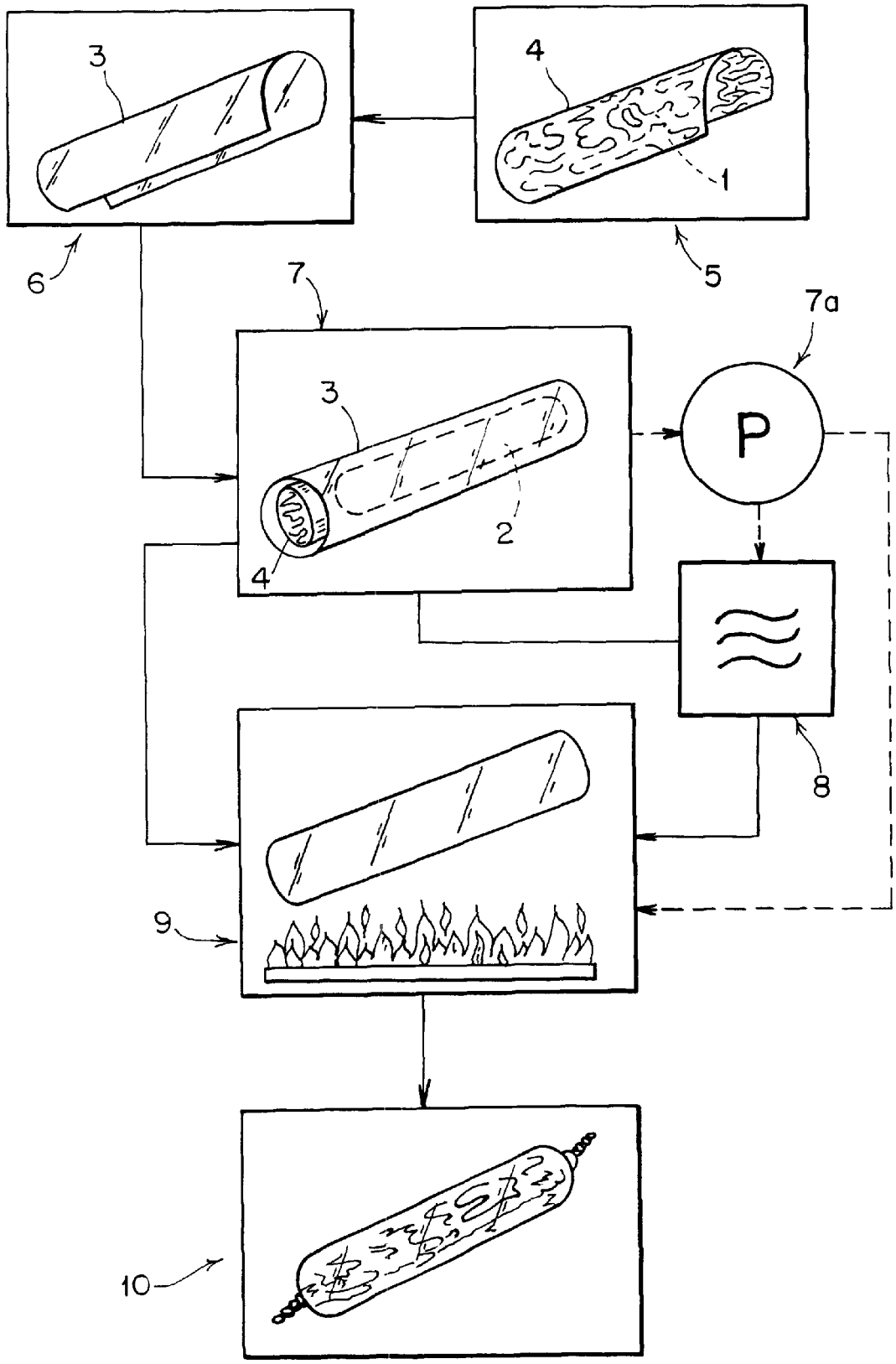
FIG. 1 shows by a block diagram the execution stages of the process according to the invention.

With reference to the aforementioned figures, the sublimation printing process provides for the preformed images 1, obtained with sublimable inks, to be compressed on the surfaces to be printed and also submitted to heating, until there is obtained, by effect of pressure and temperature, the transfer and penetration of the images on surfaces 2*a* of articles 2 to be decorated.

The pressure must ensure only a close touch between the inks and surfaces 2*a*.

The temperature must be at least comprised between 180 and 215° C., depending on the inks and colours utilised. However, at a temperature from about 220° C. to 250° C. one is sure to obtain in any case sufficient thermal conditions.

Furthermore, at the highest temperatures, such as for example 250° C., it is possible to reduce substantially the duration of the operations so increasing considerably the productivity.

According to the invention, the preformed images are compressed by thermoretroaction of thermoretractable material 3.

In detail, as figures show, preformed images 1 are preferably arranged on sheets 4 from paper or fabric or other flexible material, and these sheets 4 are inserted between surfaces 2a and the thermoretractable material 3, before executing sublimation printing. As an alternative, sheets 4 may be steadily coupled to the thermoretractable material 3 before its application on surfaces 2*a*. Images 1 may be also directly printed on the thermoretractable material 3.

Once the thermoretractable material 3 is applied on articles 2, with the interposition of images 1, thermoretraction may take place according to two distinct methods.

In the first method, a special preheating stage to a temperature of about 100° C. is executed as a first step. In these conditions, material 3 retracts in a few seconds, pressing the sublimable ink on the articles to be printed.

Preheating may be carried out by any heat source, for instance with hot air Jets which may be advantageously so oriented as to act on chosen points of material 3. In this way, it is possible to locally vary the effect of printing, even if sublimable inks are uniformly arranged.

After thermoretraction, parts of material 3 tightly wrapping articles 2 may be removed, for instance by a simple cut, so as to prepare possible zones clearly unprinted, even in the presence of diffuse images on all articles 2.

Afterward, the usual heating to about 220° C. is carried out to obtain sublimation.

According to a variant of this process, the preheating stage is not carried out and thermoretraction takes place spontaneously at the start of the heating stage in view of sublimation.

According to a further variant, before the preheating stage or before the heating stage, an air suction stage is carried out between the thermoretractable material 3 and surfaces 2*a*.

This has the aim of further increasing pressure and preventing the shrinkage of the thermoretractable material 3 from being hindered by air, if no vents exist for the same.

Besides, the pressure exercised may be varied by varying the thickness and the number of layers of the thermoretractable material. After said preheating stage, if any, articles 2 to be printed may also been stored if, for any reason whatever, the printing cannot be carried out immediately. In this way, the thermoretractable material 3 is utilised as a case for the articles.

In the same way, after the sublimation printing the thermoretractable material 3 may be utilised as a packing or protection material. Hence, the same is not directly removed from the decorated articles.

This has also the aim of allowing inks to cool, in order to prevent the dispersion of solvent vapours in the environment.

FIG. 1 shows a block diagram of all the stages of the process as described hereinabove.

In particular, one notices that by 5 and 6 there are respectively indicated the preparation stages of sheet 4 with image 1 to be printed, in sublimable ink, and of the thermoretractable material 3. The two stages may be correlated and united to each other, by associating immediately sheet 4 or the same image 1 to material 3.

By 7 there is indicated the wrapping and preparation stage of an article 2, which in 9 is directely exposed to heating to obtain sublimation printing, which heating causes at the start the thermoretraction of material 3.

Alternatively, in 8 there is first carried out a preheating purposive to obtaining thermoretraction. A sucking stage, auxiliary and optional, may be carried out in 7*a*, directly after stage 7 and before stage 8 and/or 9.

The final stage 10 concerns the treatment of articles 2, already printed but stil wrapped by the thermoretracted material 3.

The invention also provides for the realisation of an apparatus 11 for carrying out the above described process.

Figure 2:
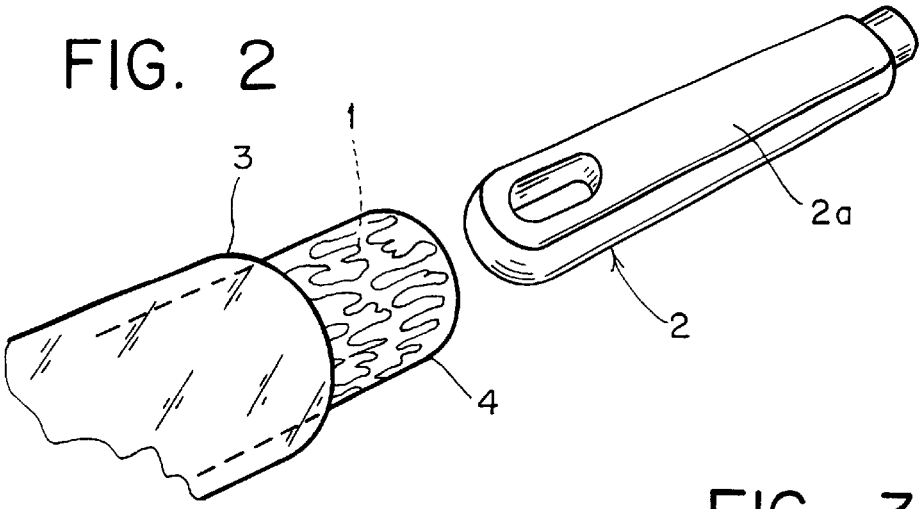
FIGS. 2–4 show an apparatus whereby the process of FIG. 1 is continuous-realised, and FIG. 5 stresses the way the already decorated article appears.
Figure 5:
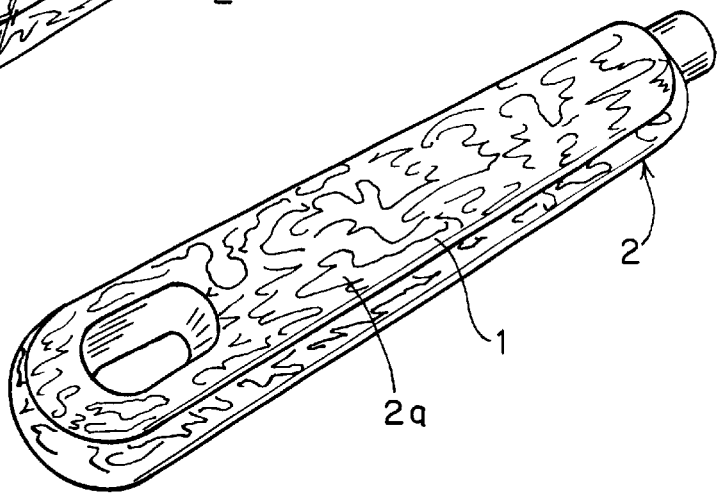

Apparatus 11 comprises the already mentioned elements 1–4, and the thermoretractable material 3 realises means for pressing images 1 on surfaces 2*a* of articles 2 represented—by way of example, as shown in particular by FIGS. 2 and 5—by a handle for kitchen tools.

The selected thermoretractable material 3 is polyethylene terephthalate in the form of a transparent film thermoretractable in one only or both directions. This material, commonly called also polyetylene-terephthalate or polyethylene terephthalate or polyethylenglycol terephthalate, is commonly indicated by the initials PETP or PET. It is comprised of a polyester of ethylene glycol with terephthalic acid, having the formula:

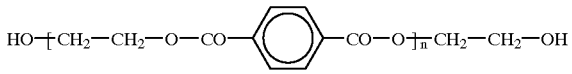

Polyethylene terephthalate is a thermoplastic material that melts at about 265° C. and which has a glass transition temperature comprised between 70 and 80° C.

At temperatures higher than the glass transition temperature, the material may be so "stretched" or "drawn" as to obtain films having molecular chains oriented towards one direction or two directions transversal to each other. In fact, at said temperature, the stressed molecular chains untangle and orient.

Once cooled, said films keep the orientation of the macromolecules and crystallise in oriented lattices, acquiring in this way excellent mechanical characteristics, as cohesion strengths between oriented macromolecules are much higher than those between non-oriented or tangled macromolecules.

Actually, films from polyethylene terephthalate axially or biaxially oriented and crystallised are at present known in the art as being the transparent films from plastic material having the best physical and mechanical characteristics.

If polyethylene terephthalate is not only drawn at a temperature higher than glass transition temperature to orient the molecular chains, but is also cooled very quickly—while drawing is still being carried on—to a temperature lower than said temperature, drawing strains remain frozen in the material, which does not shrink any more to the starting size and keeps the shape imposed during the drawing.

A further heating causes macromolecules to regain a certain degree of freedom and polyethylene terephthalate to return to the starting shape, before the drawing, even though with the macromolecules still oriented. This is the thermoretraction phenomenon Advantageously, the so treated polyethylene terephthalate shows, when it is heated again to a high temperature, by way of example to substantially 100° C., a spontaneous shrinkage equal to substantially 50% the original size.

Particularly advantageous and suitable is a material known and sold by DUPONT with the name "MYLAR HS". Given the excellent physical and mechanical characteristics of this plastic material, the same can exercise, by shrinking, a pressure more than sufficient for the sublimation printing needs Therefore, it is not necessary to suck air between material 3 and article 2 to be printed, in order to exploit the atmospheric pressure, even though an auxiliary air suction may always be carried out.

However, air vents must be provided for in any case, for instance through small holes in material 3 or through the use of tubular shape thermoretractable material 3.

Figure 3:
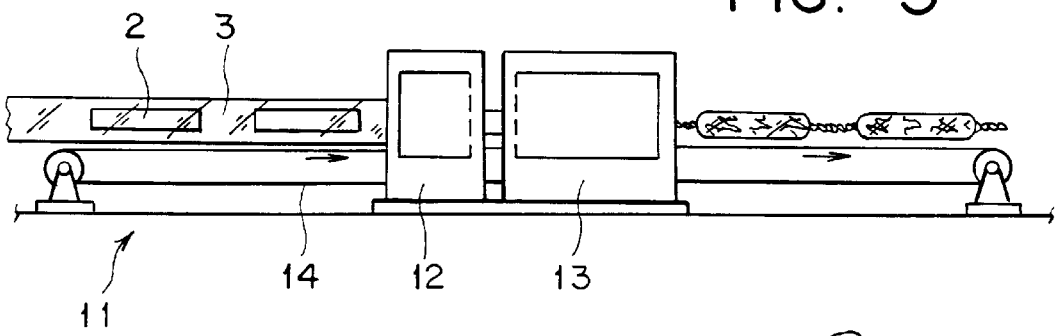
Figure 4:
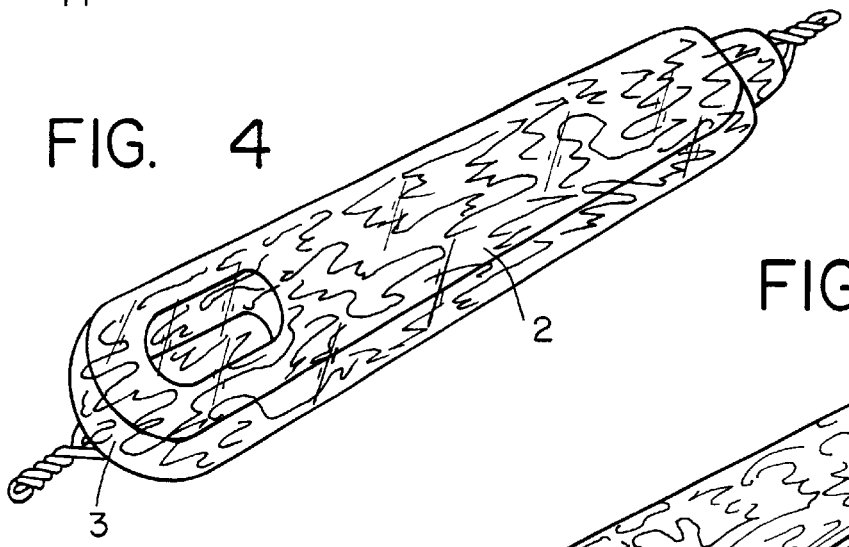

Preferably, material 3 is tubular and suitable to sequentially house the articles to be printed, as is schematically shown in FIG. 3. In this way, all printing operations may be continuously carried out. Obviously, material 3 may be also constituted by sheets or bags or sacks or strips, so as to wrap the articles to be printed in the most convenient way. The retractable material 3 may also have various thicknesses and various layers.

Besides, it may advantageously incorporate means suitable to facilitate its removal after the sublimation printing: for instance, it may incorporate pulling out threads.

The preformed images 1 are prepared on sheets, possibly coupled by gluing or the like to the internal face of the retractable material 3 and the same material 3 may have images 1 on its internal face.

There are also provided preheating means 12 and heating means 13, that can obtain thermoretraction respectively transfer of images 1 on surfaces 2*a*.

Preheating means 12 are, for instance, hot air jets, for instance at about 100° C., so orientable as to possibly select thermoretraction zones. Heating means 13 are for instance constituted by an air oven at about 220° C.

Preheating means 12 and heating means 13 may substantially coincide: in such case, the air oven performs initially thermoretraction and then ink-sublimation.

In FIG. 3 a conveyor belt 14 transports continuously the articles to be printed or decorated, inserted in a tubular shape thermoretractable material.

The process according to the present invention is particularly advantageous for decorating profiles, of a length up to 20 meters and the like, or plates also of large dimensions variously shaped by means of geometrical design, floral decorations, imitation of wood and the like.

More particularly, the process for painting and/or decorating profiles of metal constituted by semifinished extruded or drawn profiles of aluminium alloys and the like, or variously shaped plates utilising the technique of the transfer of one-colour or multi-colour patterns or decorations in sublimable colours from a support by means of the combined action of pressure and temperature, characterised in that it consists in:

- submitting the raw profile or the plate to usual preliminary operations of treatment (cleaning, degreasing, chemical and/or electrolytic conversion, anodization, etc.), then
- submitting it to one or more preliminary painting cycles, realisable with fluid or powder paints, carrying out a first operation with paints of a prefixed colour and such as to constitute a coat of primer, and a possible subsequent operation with transparent paints to avoid phenomena of diffusion with the colours of the transfer support, then
- after the complete polymerisation of said painting cycles carrying out the wrapping or the covering of the profile or the plate, with said transfer support, and then
- wrapping up the profile or the plate already wrapped in said support with a sheet or a strip from thermoretractable material, then
- submitting the so treated profile or plate to a heating action variable in function of the dimension of the profile up to about 280° C., for a time ranging from about 30 seconds to 30 minutes, to perform the thermoretraction of said thermoretractable material and the transfer and the polymerisation of the final colours from the transfer support to the profile or the plate.

Alternatively, as already said, the drawing or decoration to be transferred is realised directly upon said sheet or strip from thermoretractable material, which so acts also as transfer support, and this, as it is apparent, allows to avoid the process step consisting of the wrapping the article to be decorated with the transfer support made of paper, fabric or the like.

The application of the decoration made of sublimable colours upon the strip made of thermoretractable material can be advantageously realised for example by means of a process of the type as described and claimed in the European Patent application No. 98100975.6 comprising the steps:

preparation of an engraved metal matrix carrying an impression equal to said decoration by means of known techniques such as photoengraving and the like;

application of said decoration realised with sublimable inks on a sheet or a strip from flexible non extensible material such as polyethylene or polypropylene according to known inking techniques, by means of said metal matrix;

transfer of said decoration from said flexible non extensible sheet or strip to a sheet or strip from thermoretractable material such as polyethylene terephtalate, by heat compression of said flexible non extensible sheet or strip against said sheet or strip from thermoretractable material, obtaining a thermoretractable transfer support carrying said sublimable colour decoration.

Lastly, it must be stressed that the invention teaches also a new use of the thermoretractable material, which is utilised originally as a pressing unit in printing processes based on sublimation transferable inks.

Most particularly, there is taught a new use of a polyethylene terephthalate film thermoretractable in one only or both directions, utilised as a pressing unit in said printing processes.

The invention achieves several advantages.

In fact, the process and the apparatus may be applied with the utmost precision on articles of any shape, without giving rise to poor or imprecise printing zones.

Printing may be controlled easily as concerns the pressure exercised, varying also—for instance with the thicknesses of the thermoretractable material—the pressure from zone to zone.

The process and the apparatus may be realised in various ways, but always economically, and they may be adapted to both small production or mass production.

Among other things, the normal transparency of polyethylene terephthalate facilitates remarkably the positioning of the sheets bearing the sublimable ink, and it is not necessary to prepare the parts to be printed, for instance by closing the holes, given the resistance of polyethylene terephthalate.

With the simple measure of not removing immediately the thermoretracted material, any environment pollution due to the presence of solvent vapours is avoided. Indeed, it is useful to keep the thermoretractable material as a protective sheath.

It must also be stressed that the material in question does not causes disposal problems, being chemically classified as non reactive and biologically inert. The invention is susceptible of many modifications and variants, all of which fall within the scope of the inventive concept.

For instance, it is possible to replace polyethylene therephthalate (PET) with polyethylene naphthalate, commonly called PEN, which may be considered as a sort of PET having improved characteristics in many cases.

The two materials in question show actually a rather similar behaviour, even though polyethylene terephthalate, at present more expensive, has for instance a higher mechanical resistance and a higher glass transition temperature, equal to about 122° C.

The latter requires a higher heating temperature to obtain thermoretraction, which temperature is however lower than that necessary to obtain the sublimation of sublimable inks.

What is claimed is:

1. A process for painting and decorating an article comprising the following steps:

submitting said article to at least one preliminary treatment operation selected from the group consisting of cleaning, degreasing, chemical conversion, electrolytic conversion and anodization;

submitting said article to at least one preliminary painting cycle comprising applying a coat of primer using a fluid or powder paint of a given color and optionally applying a layer of transparent paint on said primer coat;

wrapping or covering said article with a transfer support on which images obtained using sublimable inks are provided;

further wrapping said article with a sheet or strip of heat thermoretractable material, said thermoretractable material being selected from the group consisting of polyethylene terephthalate (PET) and polyethylene naphthalate (PEN);

heating said article at a temperature up to about 280° C. for time from about 30 seconds to about 30 minutes in order to cause retraction of said heat thermoretractable material and transfer of said images from said transfer support to surfaces of said article.

2. A process for decorating an article according to claim 1, wherein said article is selected from the group consisting of semifinished extruded metal profiles, drawn profiles of aluminum alloys, and variously shaped plates.

3. A process for painting and decorating an article comprising the following steps:

submitting said article to at least one preliminary treatment operation selected from the group consisting of cleaning, degreasing, chemical conversion, electrolytic conversion and anodization;

submitting said article to at least one preliminary painting cycle comprising applying a coat of primer using a fluid or powder paint of a given color and optionally applying a layer of transparent paint on said primer coat;

wrapping or covering said article with a transfer support on which images obtained using sublimable colors are provided, said transfer support comprising a heat thermoretractable material, said thermoretractable material being selected from the group consisting of polyethylene terephthalate (PET) and polyethylene naphthalate (PEN);

heating said article at a temperature up to about 280° C. for a time from about 30 seconds to about 30 minutes in order to cause retraction of said heat thermoretractable material and transfer of said images from said transfer support to surfaces of said article.

4. A process according to claim 3, further comprising:

preparing an engraved metal matrix carrying an impression corresponding to said images;

printing said images on a sheet or strip of flexible non-extensible material using said metal matrix and sublimable inks, said material being selected from the group consisting of polyethylene and polypropylene;

transferring said images from said sheet or strip of flexible non-extensible material to a sheet or strip of heat thermoretractable material, said heat thermoretractable material being selected from the group consisting of polyethylene terephthalate (PET), and polyethylene naphthalate (PEN), said transferring being obtained by heat pressing said sheet or strip of flexible non-extensible material against said sheet or strip of heat thermoretractable material.

5. A process for printing and decorating an article by means of sublimable inks, comprising providing preformed images on a substrate, said preformed images being obtained using said sublimable inks;

applying said substrate on surfaces of said article;

applying a pressure to said preformed images for pressing said preformed images against said surfaces;

providing a heat thermoretractable material and heating said heat thermoretractable material at a temperature suitable for causing a thermoretraction of said heat thermoretractable material for generating said pressure;

heating said preformed images until said sublimable inks are transferred by sublimation onto said surfaces;

said thermoretractable material being selected from the group consisting of polyethylene terephthalate (PET) or polyethylene naphthalate (PEN); and wherein said pressure is controlled by varying the thickness and number of layers of said thermoretractable material.

6. A process according to claim 5, comprising coupling said substrate to said thermoretractable material.

7. A process according to claim 5, wherein said thermoretractable material constitutes said substrate.

8. A process according to claim 5, wherein said heat thermoretractable material is heated at said temperature before heating said images.

9. A process according to claim 5, further comprising sucking air in a region comprised between said heat thermoretractable material and said surfaces.

10. A process according to claim 5, comprising storing said articles after heating said thermoretractable material; and utilizing said heat thermoretractable material as a case for said articles waiting for a further treatment.

11. A process according to claim 5, comprising utilizing said heat thermoretractable material as a packing material for said articles when said images have been transferred on said surfaces.

12. An apparatus for printing and decorating an article by means of sublimable inks comprising compression means for applying a pressure to images provided on a substrate applied on surfaces of said article;

said images being obtained using sublimable inks;

heating means for heating said images at a temperature suitable for obtaining a transfer of said images on said surfaces by sublimation of said sublimable inks;

said compression means comprising a heat thermoretractable material;

said thermoretractable material being selected from the group consisting of polyethylene terephthalate (PET) and polyethylene naphthalate (PEN); and wherein said heat thermoretractable material has a thickness and a number of layers depending on said pressure.

13. An apparatus according to claim 12, further comprising preheating means for preheating said heat thermoretractable material at a temperature suitable for causing a thermoretraction of said heat thermoretractable material.

14. An apparatus according to claim 12, wherein said heat thermoretractable material is tubular in shape so as to be capable of housing a sequence of said articles.

15. An apparatus according to claim 12, wherein said heat thermoretractable material incorporates removal means for removing said heat thermoretractable material from said articles.

16. An apparatus according to claim 12, wherein said preformed images are printed on sheets steadily coupled to said heat thermoretractable material.

17. An apparatus according to claim 12, wherein said preformed images are printed on said heat thermoretractable material.

* * * * *